US009170517B2

(12) United States Patent
Izawa et al.

(10) Patent No.: US 9,170,517 B2
(45) Date of Patent: Oct. 27, 2015

(54) ELECTROPHOTOGRAPHIC METHOD

(71) Applicants: Hideo Izawa, Narashino (JP); Takao Namiki, Narashino (JP); Junichi Setoyama, Narashino (JP)

(72) Inventors: Hideo Izawa, Narashino (JP); Takao Namiki, Narashino (JP); Junichi Setoyama, Narashino (JP)

(73) Assignee: Miyakoshi Printing Machinery Co., Ltd., Chiba (JP)

( * ) Notice: Subject to any disclaimer, the term of this patent is extended or adjusted under 35 U.S.C. 154(b) by 0 days.

(21) Appl. No.: 14/300,929

(22) Filed: Jun. 10, 2014

(65) Prior Publication Data

US 2014/0294454 A1 Oct. 2, 2014

Related U.S. Application Data

(62) Division of application No. 13/308,031, filed on Nov. 30, 2011.

(30) Foreign Application Priority Data

Nov. 30, 2010 (JP) ..... 2010-266846

(51) Int. Cl.

| | |
|---|---|
| ***B41J 29/38*** | (2006.01) |
| ***G03G 13/16*** | (2006.01) |
| ***G03G 15/16*** | (2006.01) |

(52) U.S. Cl.
CPC ..... *G03G 13/16* (2013.01); *G03G 15/1695* (2013.01)

(58) Field of Classification Search
CPC ..... G03G 15/1695; G03G 13/16
See application file for complete search history.

(56) References Cited

U.S. PATENT DOCUMENTS

| | | | | |
|---|---|---|---|---|
| 5,370,961 | A | 12/1994 | Zaretsky et al. | |
| 2003/0231912 | A1 | 12/2003 | Ide | |
| 2007/0180277 | A1 * | 8/2007 | Jayaram et al. | 713/300 |
| 2008/0101806 | A1 | 5/2008 | Tabata et al. | |
| 2009/0169254 | A1 | 7/2009 | Izawa et al. | |

FOREIGN PATENT DOCUMENTS

| | | |
|---|---|---|
| JP | 06-118809 | 4/1994 |
| JP | 2001-117378 | 4/2001 |
| JP | 2008-065025 | 3/2008 |
| JP | 2009-157176 | 7/2009 |

* cited by examiner

*Primary Examiner* — Matthew G Marini
*Assistant Examiner* — Ruben Parco, Jr.
(74) *Attorney, Agent, or Firm* — Cozen O'Connor

(57) ABSTRACT

An electrophotographic apparatus and method that can effect favorable transfer of a toner image onto a medium under a nip pressure between a transfer roller and a backup roller and a potential difference between the transfer and backup rollers even if the medium has a high insulating property, such as due to its being thick.

3 Claims, 2 Drawing Sheets

PRIOR ART

ELECTROPHOTOGRAPHIC METHOD

REFERENCE TO RELATED APPLICATIONS

This is a division of U.S. patent application Ser. No. 13/308,031 filed Nov. 30, 2011, which is incorporated by reference herein. Priority is claimed on Japanese Application No. 2010-266846 filed Nov. 30, 2010, the content of which is incorporated herein by reference in its entirety.

BACKGROUND OF THE INVENTION

1. Field of the Invention

The present invention relates to an electrophotographic apparatus such as a printing press, copier, printer or facsimile machine and, more particularly, to an electrophotographic apparatus in which after a toner image developed on a peripheral surface of a photoconductor drum is transferred onto a transfer roller, the toner image transferred onto the transfer roller is transferred onto a medium such as a web of paper or a film passing between the transfer roller and a backup roller driven to rotate in contact with the transfer roller.

2. Description of the Related Art

In FIG. 1 there is diagrammatically shown a conventional wet electrophotographic apparatus using a photoconductor drum, a transfer roller and a backup roller. In the Figure, numeral 1 denotes the photoconductor drum, numeral 2 denotes the transfer roller in rotational contact with the photoconductor drum 1, and numeral 3 denotes the backup roller in rotational contact with the transfer roller 2. See JP 2009-157176 A.

In the electrophotographic apparatus in image forming, the photoconductor drum 1 is driven by drive means such as a motor (not shown) to rotate at a fixed speed in the direction of arrow. The photoconductor drum 1 has a peripheral surface charged uniformly by a charging unit 4 in dark and then irradiated with light from an exposure unit 5 to form an original light figure on the peripheral surface of the photoconductor drum 1 to form an electrostatic latent image on the peripheral surface. Thereafter, the electrostatic latent image as it passes through a development region is visualized with a liquid toner by a developing unit 6, forming a toner image on the peripheral surface of the photoconductor drum 1.

The toner image on the peripheral surface of the photoconductor drum 1 is primarily transferred in a primary transfer region onto a peripheral surface of the transfer roller 2 under a bias voltage applied through the transfer roller 2 and under a nip pressure between the photoconductor drum 1 and the transfer roller 2. The toner image so primarily transferred is secondarily transferred in a secondary transfer region onto a medium 7 passing between the transfer roller 2 and the backup roller 3. In the apparatus shown, there are also provided a photoconductor cleaner 8*a* for removing a toner residual on the photoconductor drum 1, a transfer roller cleaner 8*b* for removing a toner residual on the transfer roller 2, a static eliminator 9*a* and a carrier liquid supply unit 9*b*.

In the electrophotographic apparatus of this sort, if the toner image formed on the peripheral surface of the photoconductor drum 1 is positively charged, the transfer roller 2 and the backup roller 3 are to have a voltage applied thereto that is of a polarity opposite to the charging polarity of the toner on the peripheral surface of the photoconductor drum 1, i.e., a negative voltage on the backup roller 3 made more negative than that on the transfer roller 2. Thus on the medium passing between the rollers 2 and 3 there is transferred the toner image on the peripheral surface of the transfer roller 2 under a nip pressure between the two rollers and under a potential difference between the two rollers.

Thus in such an electrophotographic apparatus, if the medium 7 used is high in insulating property tending to obstruct the potential difference between the transfer roller 2 and the backup roller 3, e.g., if it has a large thickness, the transfer between the transfer roller 2 and the backup roller 3 tends to be not made by the potential difference between the two rollers, there being no transfer thereby, but only by the nip pressure between them, there being a transfer only thereby, giving rise to the problem that the transfer is not done well. While when the medium is thick it is conceivable to achieve a potential difference enough to transfer the toner image by increasing an absolute value of the voltage applied to the backup roller 3, in the state that the medium 7 is not passed between the transfer roller 2 and the backup roller 3 the increased voltage in absolute value tends to bring about a discharge to the side of the transfer roller 2, leading to the problem that rubber on the transfer roller 2 may be destructed.

Made in view of the foregoing, the present invention has for its object to provide an electrophotographic apparatus that can effect favorable transfer of a toner image onto a medium under a nip pressure between a transfer roller and a backup roller and a potential difference between the transfer and backup rollers even if the medium used is high in insulating property such as by being thick in thickness.

SUMMARY OF THE INVENTION

In order to achieve the object mentioned above, there is provided in accordance with the present invention an electrophotographic apparatus and method in which a toner image formed on a peripheral surface of a photoconductor drum is transferred onto a peripheral surface of a transfer roller whereafter onto a medium passing through a nip portion between the transfer roller and a backup roller to which electric potentials of a polarity opposite to that of the toner image formed on the photoconductor drum are applied, the toner image on the peripheral surface of the transfer roller is transferred under a nip pressure between the transfer and backup rollers and under a potential difference, between these two rollers, of the polarity opposite to that of the said toner image, wherein it comprises a medium charging charger disposed at a position which is adjacent to a medium traveling path passing through the nip portion between the transfer roller and the backup roller and which is immediately upstream of the nip portion for applying contactlessly to a surface, on the side of the transfer roller, of the medium traveling along the medium traveling path, a voltage which is of the same polarity as that of voltages applied to the transfer and backup rollers and which is of an absolute value larger than that of the voltage applied to the transfer roller and equal to or less than that of the voltage applied to the backup roller. And, in the electrophotographic apparatus described above, the medium charging charger is made capable of being turned ON and OFF.

According to the present invention, providing a medium charging charger that applies to a surface, on the transfer roller side, of the medium passing between the transfer and backup rollers and in a region immediately upstream of a nip portion between the two rollers, a voltage which is of the same polarity as that of the voltages applied to the transfer and backup rollers and which is of an absolute value larger than that of the voltage applied to the transfer roller and equal to or less than that of the voltage applied to the backup roller, allows a toner image on the transfer roller peripheral surface, as the medium is passed through the nip portion, to be transferred onto the medium surface by a potential difference between the transfer roller and the medium surface and, even if the medium is high in insulating property so as to obstruct the potential difference between the two rollers, the toner image on the transfer roller peripheral surface to be well transferred onto the medium, in the nip portion between the transfer and backup rollers, under a nip pressure between the transfer and backup rollers and under a potential difference between the transfer roller and the medium surface. Also, it is made unnecessary to apply to the backup roller a voltage increased in absolute value to an extent such as to bring about a discharge, whereby there is no discharge onto the transfer roller and hence there is no destruction of rubber on the transfer roller.

The medium charging charger, especially arranged contactlessly with a medium passing through the medium traveling path, allows its printable surface to be charged without contaminating the printable surface of the medium.

DETAILED DESCRIPTION OF THE PREFERRED EMBODIMENTS

Figure 1:
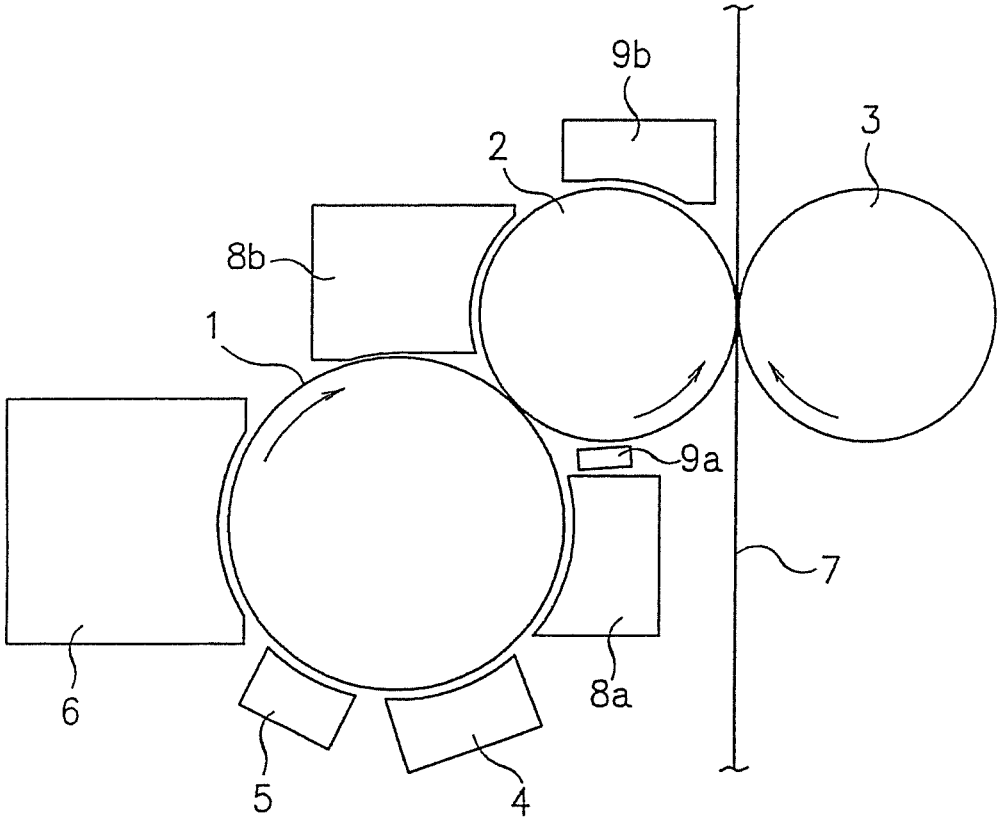
FIG. 1 is an explanatory view illustrating the makeup of a conventional electrophotographic apparatus to which the present invention is being applied.
Figure 2:
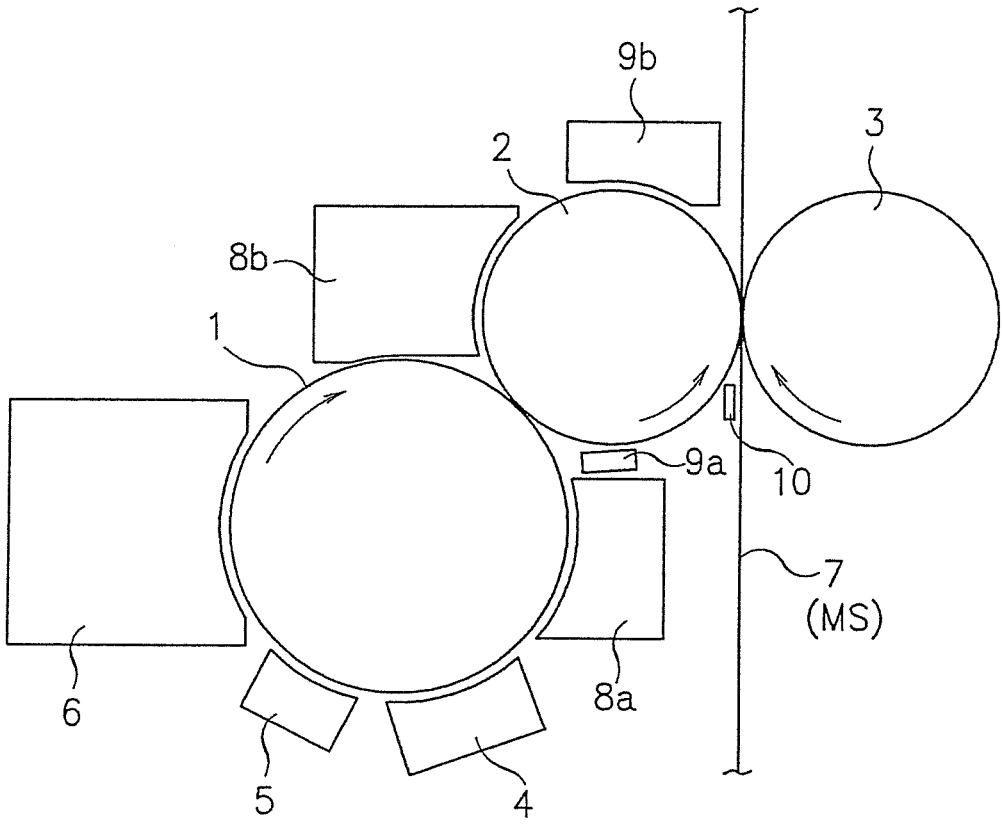
FIG. 2 is an explanatory view illustrating the makeup of an electrophotographic apparatus according to a form of implementation of the present invention.

Mention is made of a form of implementation of the present invention with reference to FIG. 2 in which parts structurally identical to those in FIG. 1 are designated by same reference numerals and explanations thereof are omitted from repetition.

At a position which is adjacent to a medium traveling path MS passing through a nip portion between the transfer roller 2 and the backup roller 3 and which is immediately upstream of the nip portion, there is provided a medium charging charger 10 opposed entirely widthwise to a surface of a medium 7 traveling along the medium traveling path MS, the surface of the medium 7 facing the transfer roller 2. The medium charging charger 10 is designed to apply a voltage to the surface (printing surface) of the medium 7 facing the transfer roller 2 entirely its widthwise, the medium traveling along the medium traveling path MS.

It is assumed that to the transfer roller 2 and the backup roller 3 there are applied by voltage generators 11 and 12, respectively, voltages of a polarity opposite to that of a toner image formed on the peripheral surface of the photoconductor drum 1, e.g., of negative polarity if the toner image is of positive polarity, e.g., a voltage of −400 volts to the transfer roller 2 and a voltage of −1400 volts to the backup roller 3. And, the medium charging charger 10 is designed to apply to the medium a voltage which is of a same polarity (negative) as that of the voltage applied to the backup roller 3 and which is more negative than the voltage (−400 volts) applied to the transfer roller 2 and which is equal to or less negative than the voltage (−1400 volts) applied to the backup roller 3.

The medium charging charger 10 is desirably positioned upstream of the nip portion between the transfer roller 2 and the backup roller 3 and as close to the nip portion as possible. And, the medium charging charger 10 is opposed contactlessly to the medium 7 traveling along the medium traveling path MS over its entire width. Also, the medium charging charger 10 is adapted to be turned ON and OFF by a control unit 13 and can be used selectively depending on the property of a medium 7 traveling along the medium traveling path MS.

While the voltages applied to the transfer roller 2 and the backup roller 3 are varied to be positive and negative depending on the polarity of charge of the toner image, note further that the polarity of the medium charging charger 10 is varied by the control unit 13 depending on the change in polarity of the backup roller 3.

Mention is next made of an embodiment in which toner particles of a liquid toner for forming the toner image on the surface of the transfer roller 2 are charged positively.

Then, as in the prior art it is assumed that a voltage of −400 volts is applied to the transfer roller 2 and a voltage of −1400 volts is applied to the backup roller 3.

In printing on the medium 7 in this state, the medium charging charger 10 is held OFF if the thickness of the medium detected by a sensor 14 is thin in thickness and thus low in insulating property.

In this state a negative potential difference between the transfer roller 2 and the backup roller 3 acts on the transfer roller 2 past the medium 7 so that the positively charged toner image formed on the surface of the transfer roller 2 is attracted onto the surface, on the side of the transfer roller 2, of the medium 7. At the same time, the medium 7 passes through the nip portion between the transfer roller 2 and the backup roller 3 the toner image on the transfer roller 2 is transferred onto the medium 7 under the nip pressure and the potential difference between the two rollers.

On the other hand, if the medium 7 used is high in insulating property, e.g., by being thick in its thickness detected by the sensor 14, so that the potential difference between the transfer roller 2 and the backup roller 3 is obstructed by the medium 7, the medium charging charger 10 is held ON. Then, by the medium charging charger 10 there is applied a voltage of −1000 volts that is of the same polarity (negative) as that of the voltages applied to the transfer roller 2 and the backup roller 3 and that is larger in absolute value than the voltage applied to the transfer roller 2 but less in absolute value than (possibly equal in absolute value to) the voltage applied to the backup roller 3.

In this state, immediately before the nip portion between the transfer roller 2 and the backup roller 3, the medium charging charger 10 applies a voltage of −1000 volts to the surface of the medium 7 on the side of the transfer roller 2 to charge the surface of the medium 7 on the side of the transfer roller 2 with the voltage of −1000 volts. Thus, when the medium 7 immediately after charging passes through the nip portion between the transfer roller 2 and the backup roller 3, it follows that between the peripheral surface of the transfer roller 2 and the surface of the medium 7 there is created a potential difference of (−1000 volts−(−400 volts))=−600 volts under which and under the nip pressure between the transfer roller 2 and the backup roller 3 the toner image on the peripheral surface of the transfer roller 2 is transferred onto the medium 7.

While the backup roller has a normal voltage (−1400 volts) applied thereto, the action by an electric potential on the side of the backup roller 3 where obstructed by the medium 7 gives rise to the state that there is less or no action by the electric potential on the side of the backup roller 3. Thus, in this case, application of the voltage to the backup roller 3 may be turned OFF.

While in the form of implementation illustrated above, voltages of −400 volts and −1400 volts are applied to the transfer roller 2 and the backup roller 3, respectively and −1000 volts is applied to the medium 7 by the medium charging charger 10, it should be noted that these voltages for application are varied properly depending on conditions of the transfer.

We claim:

1. A method of transferring a toner image onto a medium, comprising:

applying a first voltage having a first polarity to a first peripheral surface of a photoconductor drum;

forming a toner image on the first peripheral surface of the photoconductor drum, the toner image having the first polarity;

applying a second voltage to a second peripheral surface of a transfer roller, the second voltage having a second polarity opposite to the first polarity;

applying a third voltage having the second polarity to a backup roller, the third voltage being different from the second voltage to create a potential difference between the transfer roller and the backup roller;

applying a fourth voltage to a medium travelling along a medium path, through a nip portion between the transfer roller and the backup roller, the fourth voltage having a same polarity as the second and third voltages and having an absolute value larger than an absolute value of the second voltage and equal to or less than an absolute value of the third voltage;

transferring the toner image from the peripheral surface of the transfer roller to the medium travelling through the nip portion; and turning OFF the third voltage in a case where action of the electric potential difference between the transfer roller and the backup roller is obstructed by the medium.

2. A method as set forth in claim 1, comprising selectively turning ON and OFF the fourth voltage based, at least in part, on a property of the medium.

3. A method as set forth in claim 2, comprising selectively turning ON and OFF the fourth voltage based, at least in part, on a thickness of the medium.

* * * * *